US005130614A

United States Patent [19]

Staelin

[11] Patent Number: 5,130,614

[45] Date of Patent: Jul. 14, 1992

[54] RIBBON BEAM CATHODE RAY TUBE

[75] Inventor: David H. Staelin, Wellesley, Mass.

[73] Assignee: Massachusetts Institute of Technology, Cambridge, Mass.

[21] Appl. No.: 564,738

[22] Filed: Aug. 8, 1990

[51] Int. Cl.[5] ..... H01J 29/70; H01J 29/72

[52] U.S. Cl. ..... 315/366; 313/422

[58] Field of Search ..... 315/366; 313/422

[56] References Cited

U.S. PATENT DOCUMENTS

| | | | |
|---|---|---|---|
| 4,128,784 | 12/1978 | Anderson . | |
| 4,137,478 | 1/1979 | Credelle . | |
| 4,137,486 | 1/1979 | Schwartz | 315/366 |
| 4,158,157 | 6/1979 | Schwartz . | |
| 4,199,705 | 4/1980 | Anderson et al. . | |
| 4,217,519 | 8/1980 | Catanese et al. . | |
| 4,259,612 | 3/1981 | Christiano et al. . | |
| 4,298,819 | 11/1981 | Credelle et al. . | |
| 4,316,117 | 2/1982 | Carroll . | |
| 4,408,143 | 10/1983 | Inohara et al. . | |
| 4,598,227 | 7/1986 | Credelle . | |
| 4,622,492 | 11/1986 | Barten . | |
| 4,626,899 | 12/1986 | Tomii et al. . | |
| 4,658,188 | 4/1987 | Bohmer . | |
| 4,745,344 | 5/1988 | Tomii et al. | 315/366 |
| 4,900,981 | 2/1990 | Yamazaki et al. | 313/422 |
| 4,927,218 | 5/1990 | Zegers | 313/422 |

OTHER PUBLICATIONS

Thin Cathode Ray Tubes by Masanori Watanabe vol. 29/3 1988.

*Primary Examiner*—Theodore M. Blum

*Attorney, Agent, or Firm*—Hamilton, Brook, Smith & Reynolds

[57] ABSTRACT

A cathode ray tube apparatus uses a ribbon electron beam to illuminate one line of information at a time on the display surface of the tube. The resulting increase in scanning speed allows for a reduced beam current density and corresponding reduction in electrostatic spreading. The beam is focusable to a smaller spot which allows enhanced image resolution. Velocity filters enhance resolution in the plane of the ribbon beam. A linear modulation assembly allows the ribbon beam to be modulated prior to deflection, removing the need for a full modulation grid. Thin septa are provided to support the tube against compressive external forces. The septa are tapered near the display surface where septum electrodes draw electrons of the beam toward the septa near the display surface to prevent image discontinuity. Rapidly-varying high voltages are provided by an electron gun directed toward receiving anodes which absorb electron energy and transfer resulting voltages to storage circuits which service high voltage electrodes.

73 Claims, 6 Drawing Sheets

RIBBON BEAM CATHODE RAY TUBE

BACKGROUND

The cathode ray tube (CRT) is the most common form of video display device and is used widely for television sets, computer terminals, and various other video display purposes. The CRT is an evacuated chamber in which a hot cathode emits electrons which are directed with focusing elements toward a transparent, phosphor-coated screen. As the electrons strike the screen, they are absorbed by the phosphorescent coating on the screen which emits visible light seen by a viewer looking at the other side of the screen.

Typically, the phosphor screen of a CRT is divided into a number of small spots, called picture elements or "pels", each of which may be separately illuminated by the cathode electrons. By directing electrons from the cathode to illuminate only desired pels, an image may be formed on the screen which is made up of that selected group of pels. Since the phosphorescent screen material glows for a finite period of time after absorbing the electrons from the electron beam, sequentially illuminating the desired pels fast enough results in an image displayed on the screen which appears to be simultaneous and continuous. The time which a phosphor glows after absorbing a particular amount of electron beam energy is called the "persistence" of the phosphor.

Traditionally, the source of electrons for a CRT is an "electron gun" which uses a cathode to emit electrons which are formed into a single, linear electron beam. The electron gun then accelerates and focuses the electron beam using a series of controllable field-generating elements. These elements generate electric or magnetic fields which control the intensity and the direction of the electron beam. Usually, the electron beam is "scanned" across the screen one row at a time. The scan must be therefore be fast enough to "refresh" the glowing phosphor of the screen to prevent perceived image discontinuity.

One of the problems encountered in the design of CRT's is how to achieve a high density of pels on the CRT screen. As the electron beam is focused by the electron gun focusing elements, and as it travels toward the screen, the mutually repulsive electrostatic forces of the electrons comprising the beam force the beam to spread apart. For a particular beam current, voltage, and shape, a minimum spot diameter exists beyond which the beam can not be focused. This, in turn, limits the density of pels on the screen.

The focus spot diameter may be reduced by reducing the beam current, which consequently reduces the repulsive electrostatic forces. However, reduction of the beam current also reduces the electron beam energy absorbed by each pel of the screen phosphor. Traditional methods for increasing the number of pels in an image beyond some nominal limit include: 1) increasing the beam voltage, which reduces beam spreading and increases pel brightness, 2) use lower beam currents and oblige viewers to sit in a darkened room, 3) use more highly converging beam shapes with wider diameters in the focusing region, and 4) use multiple beams simultaneously.

SUMMARY OF THE INVENTION

A cathode ray tube apparatus is provided having a cathode which is emitting a ribbon beam of electrons propagating in a first direction. The ribbon beam is being modulated by a linear modulation assembly. The modulated ribbon beam is directed by a beam directing electrode assembly toward a phosphor-coated display surface. Absorption of electrons of the ribbon beam by the phosphor coating causes the emission of visible light from the display surface.

The electrode assembly consists of a plurality of beam-steering electrodes which uniformly accelerate the electrons of the ribbon beam. The electrodes expand the depth of the ribbon beam before reconverging it to a focused line at the display surface. The ribbon beam is swept across the display surface by the electrode assembly in a display surface at a time. Direction of the beam with the electrode assembly allows the cathode ray tube apparatus to be housed in a flat display package, such as could be hung in a wall for display purposes.

To reduce electron velocities in the plane of the ribbon beam which are in a direction perpendicular to the propagation direction of the ribbon beam, an electrostatic velocity filter may be provided. The velocity filter consists of a plurality of velocity filter plates perpendicular to the plane of the ribbon beam, but parallel to one another and to the propagation direction of the ribbon beam. The plates absorb those electrons which have an unacceptably high velocity perpendicular to the plates.

To support the cathode ray tube against compressive external forces, a plurality of thin septa can be positioned between the display surface and an opposing surface in the tube. The septa are tapered near the display surface to prevent image discontinuities. Septum electrodes are provided in the tapered regions of the septa to allow electrons of the ribbon beam to be drawn in close to the septa near the display surface. Feedback electrodes are also provided in the tapered region to allow measurement of proximate electron beam current.

To provide the rapidly-varying high voltages necessary to control the various electrodes in the cathode ray tube, an electron gun which generates a linear electron beam is provided. The linear electron beam is directed with electrodes toward one of a plurality of anodes which receive the electron beam and convert the electron energy to electric current. Each anode is connected to a storage circuit which temporarily retains the charge delivered by the electron gun beam. The charge is separately controlled for each anode circuit by controlling some combination of beam current and beam dwell time. The rates of charge deposition on the anodes are proportional to the voltages desired. These voltages are then applied from the storage circuit to any of the system electrodes which require a rapid voltage change. The beam is commutated among the anodes with sufficient rapidity that each maintains its proper voltage within the desired tolerances. The revisit interval for each anode circuit (how often the electron beam strikes a particular anode) should be much shorter than the delay time constant for that circuit. This delay time constant should be no greater than the shortest output voltage decay time.

DETAILED DESCRIPTION OF A PREFERRED EMBODIMENT

Figure 1:
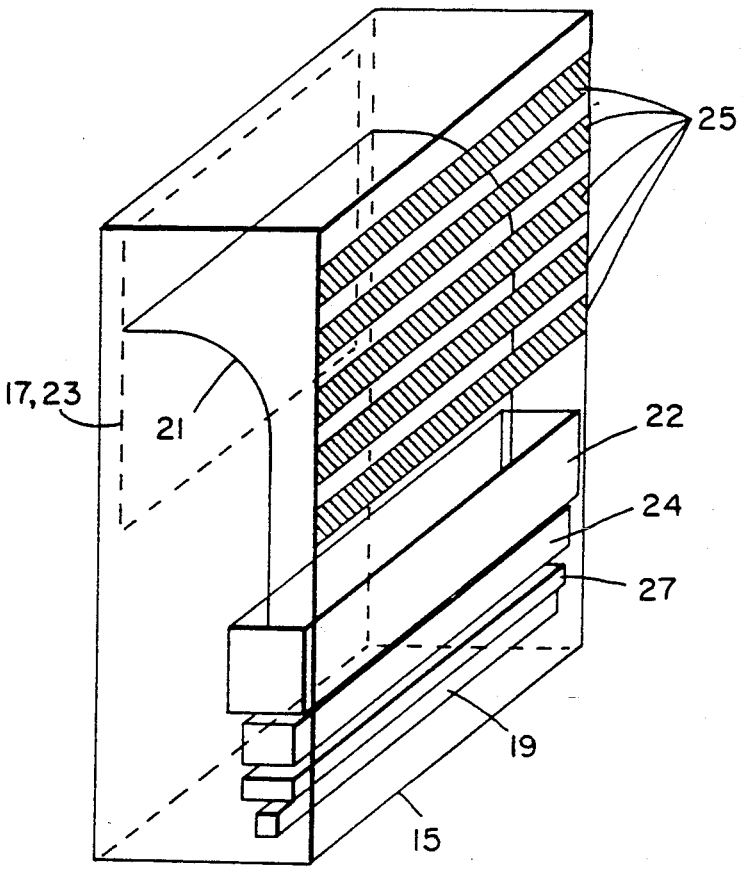
FIG. 1 is a perspective view of a flat-panel CRT according to the present invention.

Referring to FIG. 1, a thin, flat-panel CRT 15 is shown having a phosphor-coated front display surface 17. The display surface 17 is made up of an array of pels arranged in horizontal rows and vertical columns. Enclosed in the CRT 15 is an elongate cathode 19 which emits a ribbon beam 21 of electrons. The ribbon beam 21 can be uniform in intensity across its width, and the electrons of the beam have substantially parallel trajectories. As shown in FIG. 1, the beam 21 is launched parallel to the display surface 17, and is then directed toward the surface 17. The direction of the beam 2 is-accomplished by electric and/or magnetic fields generated by a beam-directing electrode assembly within the CRT 15.

The electrode assembly of the present embodiment uses a set of deflection electrodes 25 placed at the rear of the CRT, in combination with a steering electrode 23 placed next to the display surface 17 to attract the ribbon beam 21 to the desired part of the display surface 17. This steering electrode 23 is transparent to the electron beam 21 to prevent significant interference with beam excitation of the phosphors on the display surface, and provides a controllable, uniform electrical potential across the display surface 17. The deflection electrodes 25 are arranged along the rear surface of the CRT in such a manner as to allow the entire beam to be redirected uniformly toward the steering electrode 23 and the display surface so that the ribbon beam can simultaneously illuminate one entire row of pels on the display surface 17.

Other electrode arrangements can also be provided to perform the necessary directing of the ribbon beam 21. For example, the steering electrode could be replaced with multiple steering electrodes connected so as to be at a single controllable potential. As with the single steering electrode the deflection electrodes 25 are then actively controlled in conjunction with the steering electrode 23, to uniformly direct the ribbon beam 21 to a desired row of pels on the display surface 17.

The electrode assembly is the means by which the ribbon beam 21 is moved or "scanned" across the display surface 17. To scan the display surface 17, the beam 21 is deflected so it sweeps from the top to the bottom of display surface 17, or vice-versa, illuminating one line of pels at a time. As the beam 21 scans across the display surface 17, each line has pels which must be illuminated to different intensities to form the desired image. The ribbon beam must therefore be modulated across its width to control the intensity of individual beam portions as the ribbon beam 21 moves from line to line. Thus, there are at least as many individually modulated beam portions as there are pels in a row to allow each pel to be individually controlled. The number of separately modulated beam portions can exceed the number of pels being illuminated if more than one beam portion is used to illuminate a single pel.

Modulation assembly 27 lies adjacent to cathode 19 and modulates the ribbon beam 21 as it passes. In the present embodiment, each individually modulated portion of the ribbon beam corresponds to a single horizontal pel position for any one row of pels to be illuminated on the display surface 17. The intensity of each beam portion across the ribbon beam 21 is individually controlled to give the proper illumination of pels in the row being illuminated. Since the intensity information for each pel changes from line to line, the intensity of each beam portion is updated by the modulation assembly each time the beam 21 moves to scan a new line of the display surface 17. A complete image can therefore be formed on the display surface 17 as the ribbon beam makes one complete sweep across the surface 17. Thus, one sweep of the ribbon beam 21 across the display surface 17 can correspond to one frame of a video transmission.

Figure 2:
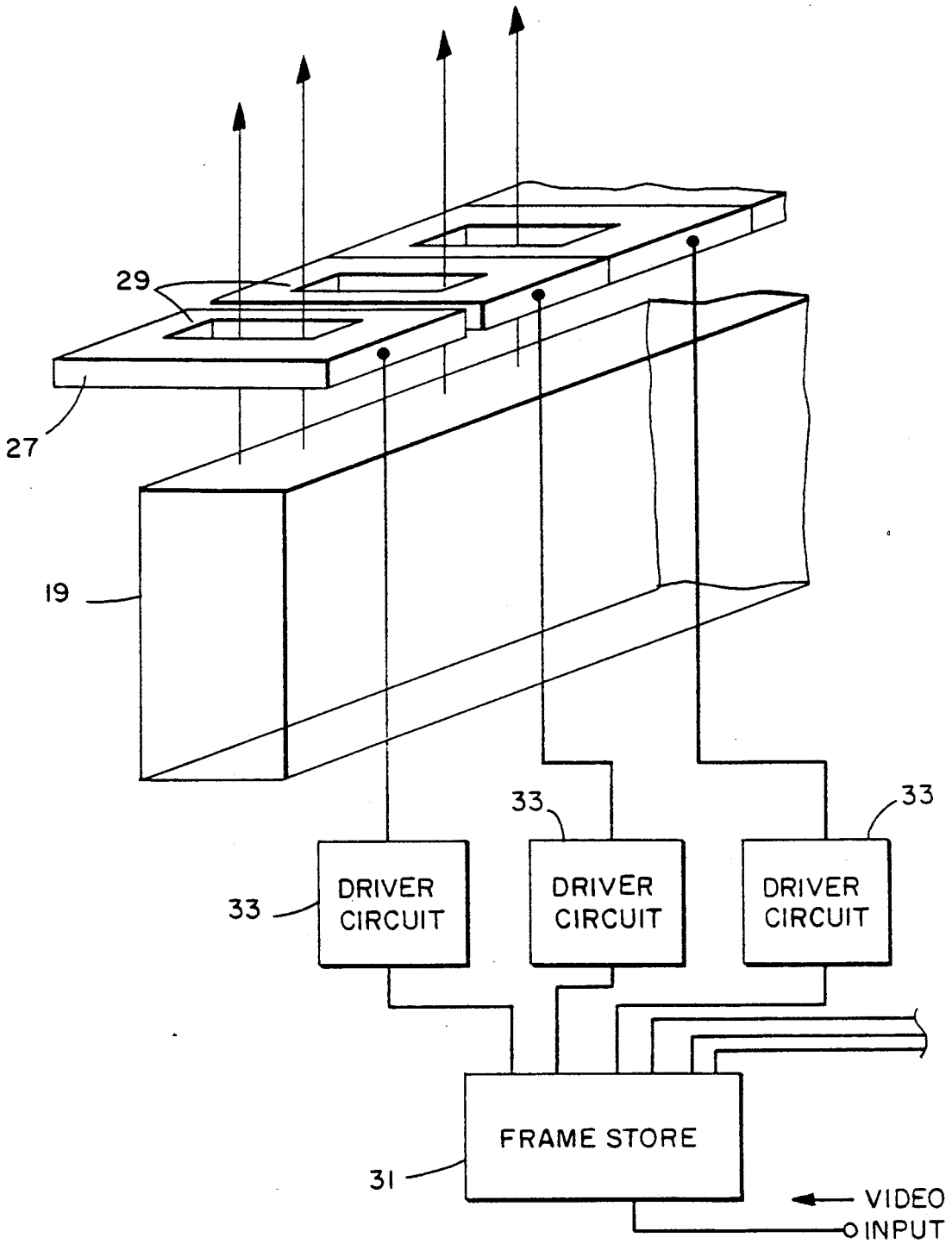
FIG. 2 is an enlarged perspective view of a section of a linear modulation grid having accompanying drive circuits shown in block diagram form.

A preferred form of modulation assembly 27 used with the present embodiment is a linear grid of individually controllable grid elements 29, implemented to modulate the ribbon beam 21 before deflection, as shown in FIG. 1. A portion of this linear modulation assembly is shown in detail in FIG. 2. Each individually modulated beam portion passes through one of the grid elements 29, the intensity of the portion being controlled by the cathode assembly and by the fields generated by that grid element 29. With each grid element 29 modulating a portion of the ribbon beam 21 corresponding to a single pel, simultaneous modulation signals to each of the grid elements 29 allows simultaneous control of the entire ribbon beam. This, in turn, allows an entire line of pels to be illuminated simultaneously. Therefore, since the ribbon beam 21 is as wide as the display surface 17, scanning is required in only one direction. As the electrode assembly directs the beam 21 from one line of pels to the next, the modulation signal in each of the grid elements 29 changes to properly adjust the intensity for each pel of the new line.

In order to simultaneously modulate the entire beam 21, the intensity control signals for the grid elements 29 must be delivered simultaneously. Since a received video signal is often transmitted serially, a frame store memory 31 is provided which receives and stores the serial input video signal and outputs control signals for the grid elements 29 in parallel. Each of the control signals is input to a driver circuit 33 which drives one of the grid elements 29. The frame store thus updates all the grid elements 29 simultaneously as the ribbon beam 21 is moved to a new line on the display surface 17.

The ability to simultaneously illuminate an entire line of pels on the display surface 17 provides the CRT 15 of the present embodiment with some distinct advantages over the traditional single linear electron beam approach. One important advantage is that the time spent scanning the entire display surface 17 can be greatly reduced because many pixels are illuminated simultaneously. If the scan time is reduced, the required persistence time of the screen phosphor is also reduced and the viewer can be presented with new frames at a greater rate and with better motion fidelity. Simultaneous illumination of many pixels allows the maximum instantaneous beam current density (amps/pel) to be reduced as well. With reduced beam density, there is a consequential reduction of electrostatic beam spreading during focusing of the beam, and each beam portion may be focused to a smaller spot. Therefore the size of each pel is reduced and the overall resolution of the screen is improved.

In the preferred embodiment, the CRT 15 has a color display surface 17 containing 1005×1000 pels, with the 1000 pel dimension being parallel to the plane of the ribbon beam 21. These dimensions are nearly arbitrary, although numbers in the range 200–4000 are most plausible. In this embodiment, each pel actually consists of three pels each of a different color, the colors preferably being red, blue and green. The ability to focus each individual beam portion to a very small spot removes the necessity for shadow masks traditionally used to prevent beam spillover from one color pel to the next. The ribbon beam is controlled to sequentially illuminate each necessary color for a pel before the ribbon beam is moved to the next line. In this embodiment, the modulation grid 27 has 1000 separate grid elements, each driven by a separate driver circuit. Therefore, for one sweep across the display surface 17, each driver circuit 33 responds to a sequence of 3015 commands (three colors/pel, 1005 lines). The frame store 31 continually updates the commands to the driver circuits 33 based on the incoming video signal.

Figure 3:
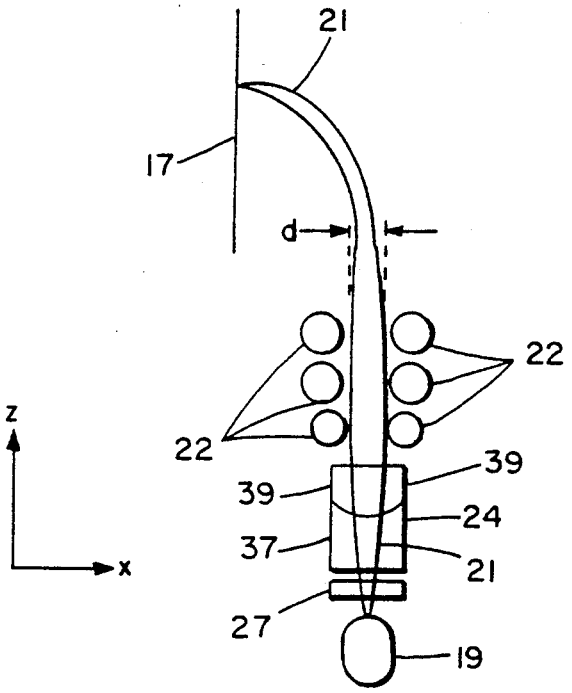
FIG. 3 is an end view of a ribbon beam and beam emitting modulating and focusing assembly.
Figure 4:
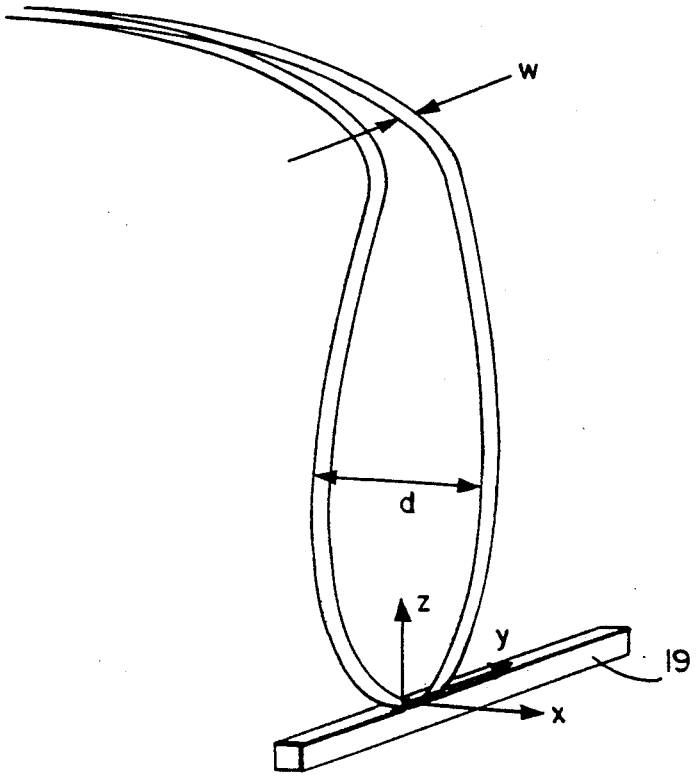
FIG. 4 is a perspective view of the cathode element of FIG. 3 illustrating the beam current associated with a single pixel.

FIG. 3 is an instantaneous side view of a ribbon beam 21 as used in the present invention. In FIG. 3, dimension x represents position in a direction generally perpendicular to the ribbon beam 21, z is position in the propagation direction of the ribbon beam 21, and y is orthogonal to z in the plane of the ribbon beam 21. The electrons emerge from the cathode assembly 19 and pass through the modulation assembly 27, and then through a velocity filter assembly 24 and a beam-focusing assembly 22 made up of a set of focusing electrodes. The maximum depth d of the ribbon beam in the x-direction is shown exaggerated in FIG. 3. This depth measurement demonstrates a focusing technique used in the present embodiment in which the beam is expanded in the x-direction to reduce electrostatic forces prior to focused convergence at the display surface 17. FIG. 4 shows this technique in an isolated view of a portion of the ribbon beam 21 associated with one pel. The width w shown in FIG. 4 is the width of the illustrated beam portion in the y-direction. Due to good local uniformity and low electrostatic spreading, the width w is nearly constant from the cathode 19 to the display surface 17.

The focusing of the beam 21 in the x-z plane is a simple two-dimensional variation of the classic three-dimensional electron beam focusing problem and is well understood in the art. There are a number the electrode assembly to control the beam in the x-y plane, while still reducing coma. In FIG. 3 and FIG. 4, the depth of the ribbon beam 21 is controlled by the focus assembly 22. The beam is expanded in the x-z plane without disturbing electron trajectories in the y-direction. The beam is expanded to the maximum depth d, the point of minimum intra-beam electrostatic repulsive force. The focus assembly 22 then reconverges the beam so that it comes to a narrow line at the display surface.

Although the electrostatic spreading effects are already significantly reduced by the reduction in beam current density, the beam depth d is made large enough to render the electrostatic beam spreading effects negligible. To increase the resolution of the display surface 17, a reduction in dimension w may be necessary. A corresponding increase in electrostatic spreading may be prevented by compensating for the reduction in w by increasing d.

In addition to electrostatic beam spreading, the ribbon beam may suffer the effects of thermal spreading. When electrons leave the cathode 19 they have thermal energies in the y-direction on the order of 0.1 electron volt (eV). This energy is proportional to the cathode 19 temperature. Although electron velocity in the y-direction due to this energy is small on a relative scale, it could significantly smear the beam by the time it reaches the display surface 17. The traditional approach to this problem is to provide focusing in the y-z plane. However, in the present embodiment the technique of electron velocity filtering is preferred. The narrowness of the beam portions make the y-z focusing of each beam portion undesirable, since space is limited in the y-direction.

Figure 5:
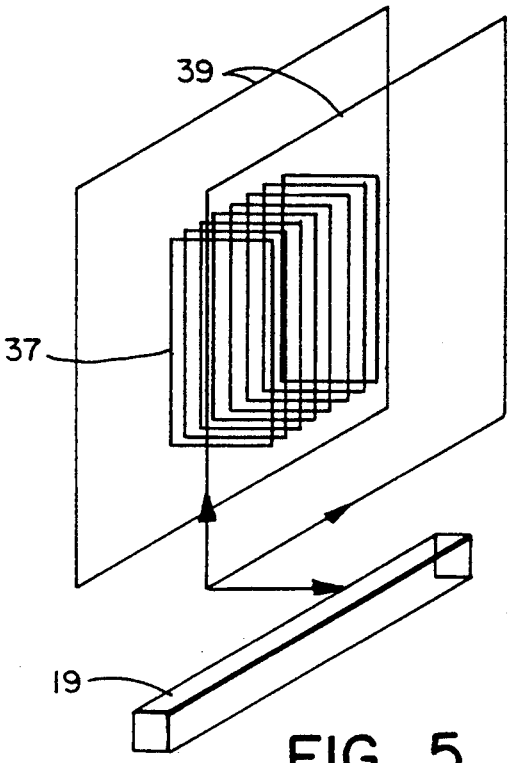
FIG. 5 is a perspective view of a ribbon beam cathode with velocity filter plates and guide plates.

The basic idea of electron velocity filtering is commonly understood in the art. FIG. 5 shows cathode 19, adjacent to which are a series of velocity filter plates 37 separated by distances determined by the width w of a single pel. The filter plates 37 are parallel with each other in the y-direction. As the ribbon beam 21 leaves the cathode 19, it is accelerated in the z-direction by the electrode assembly to a few electron volts, and then drifts through spaces between the filter plates 37. There are no fields generated in the y-z plane to affect the beam 21 propagation in the y-direction. However, the plates 37 are conductive and have a predetermined electrical potential. If the beam energy is less than the work function of the filter plates, electrons impacting the plates are likely to be absorbed, rather than reflecting or producing secondaries.

For the present example, the beam energy is assumed to be 1 volt and the filter plates are assumed to have a length in the z-direction which is 30 times the plate separation. Therefore, as portions of the beam 21 drift through the interstices of the filter plates 37, the electrons which escape without being absorbed by the filter plates have lateral energies of less than approximately $(1/30)^2$eV, or about 0.001 eV. If the surviving beam is then accelerated to 10 keV, the spreading angle of the electrons in the y-z plane is approximately $[10^{-3}\text{eV}/10^4\text{eV}]^{\frac{1}{2}}$, or about 0.0003 radians. In this example, about 90% of all electrons from the cathode 19 are absorbed, but since the beam energy in the velocity filter is only 1 volt, rather than the accelerated energy of 10 keV, only 0.1% of the final beam energy is lost.

To ensure very small lateral velocities in electrons exiting from the velocity filter, it is important to prevent extraneous lateral electric fields from being produced between adjacent plates 37 by molecular contaminants on the plate surfaces. Running the plates 37 hot periodically could help cleanse them, particularly during manufacture. In general, low contamination levels and uniform work functions over the filter plates are desired, so as to minimize random lateral electric fields between the plates.

One problem caused by the use of velocity filtering as used in the present embodiment of FIG. 5 is the generation of electric "fringing" fields at the edges of the filter plates 37. These fringing fields can add to velocities of electrons in the y-direction, and cause smearing of the filtered beam. To reduce these fringing fields, conducting guide plates 39 are provided perpendicular to the filter plates 37 as shown in FIG. 5. These plates 37 and 39 establish the potential distribution for the drift region of the filter plates 37. The guide plates 39 extend above and below the filter plates 37 sufficiently far that most external electric field lines terminate on the guide plates 39 rather than on the filter plates 37, reducing the fringing fields at the edges of the filter plates to acceptable levels.

The separation of the guide plates 39 in the CRT 15 is made narrow enough to sufficiently reduce the fringing fields of the filter plates 37. However, widening the plate separation allows the ribbon beam 21 to have more depth in the x-direction, thus reducing the charge density of the beam 21. Thus a compromise is found in the guide plate which optimizes the balance between charge density and fringing field control. The guide plates 39 may be made non-parallel with one another or the individual plates 39 may even be non-planar as long as they do not increase electron velocities in the y-direction. For example, the plates 39 may be placed strategically to aid in the focusing of the ribbon beam in the x-z plane.

Figure 6:
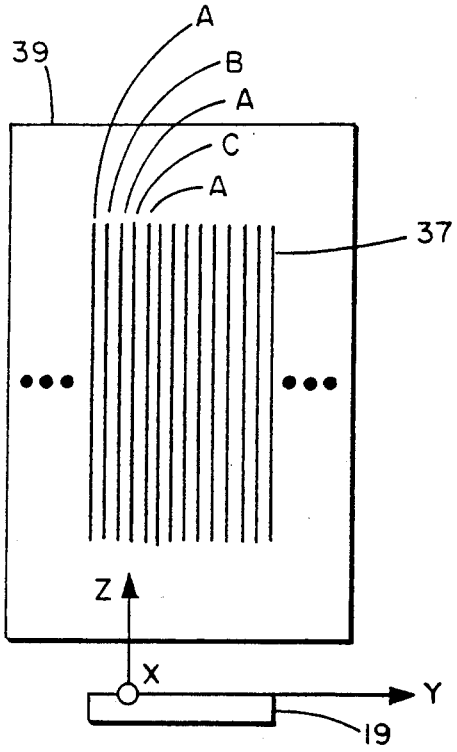
FIG. 6 is a rear view of a ribbon beam cathode and velocity filter plates.

Because the modulation grid 27 might introduce some undesired y-directed fields which would influence the ribbon beam 21, it is preferable to place the modulation assembly between the cathode 19 and the filter plates 37. In one alternative embodiment, the modulation of the ribbon beam is incorporated into the control of filter plates 37. In FIG. 6, a series of adjacent filter plates is shown, every other plate being labelled A. In the arrangement shown, all the plates labelled A are attached to the guide plates 39 and are equipotential. All the other plates, such as plates B and C, each have independently controlled potentials and can be used to redirect beam portions passing nearby. The controllable plates therefore serve as intensity modulators for the ribbon beam portions passing through the interstices on either side of each respective plate by controlling the beam current passing between the plates and therefore also the number of electrons which are absorbed on the plates. For example, if the potential of plate B is raised or lowered by as much as 0.3 volts, essentially all the electrons entering either space adjacent plate B are absorbed. Otherwise, the slots on either side of plate B both feed a single corresponding pel on the display surface 17. Thus, the intensity of the beam portion reaching that pel is controlled by the charge level on plate B.

Figure 7:
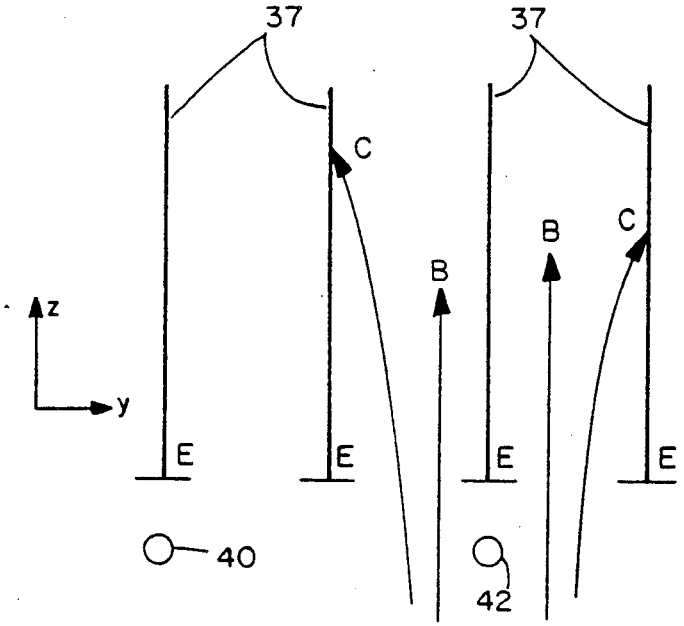
FIG. 7 is an enlarged rear view of several velocity filter plates and nearby grid wires.

Another alternative embodiment of the modulation/-filtering system of the CRT is shown in FIG. 7. Filter plates 37 are again aligned parallel to one another in x-z planes. Between the filter plates 37 and the cathode 19 are a series of grid wires such as wires 40,42 running in the x-direction. The voltage on each grid wire is actively controlled to generate electric fields which "spoil" the trajectory of electrons passing through the filter plates 37, causing them to deflect into the filter plates 37 where they are absorbed. These spoiling fields can be used to control the intensity of a beam portion passing near the wire. The greater the strength of the spoiling field, the more electrons are deflected into the filter plates 37.

In FIG. 7, the trajectories of the electrons labelled B show electron trajectories when no spoiling fields are produced by wire 42. However, when wire 42 is charged negatively relative to its surroundings, The resulting electric fields cause the electrons labelled C to be deflected in the y-direction, forcing them into contact with the filter plates 37 where they are absorbed. Since each wire is aligned with a filter plate 37 in the z-direction, the beam portion being modulated for one pel passes through two adjacent filter plate interstices. The alignment of the grid wire with the separating filter plate allows both portions to be intensity modulated by the same wire, as shown in FIG. 7. The beam portions passing on either side of a grid wire are used to illuminate the same pel. Therefore, varying the magnitude of the current passed through each wire individually allows the level of intensity modulation to be separately controlled for each pel.

Figure 8:
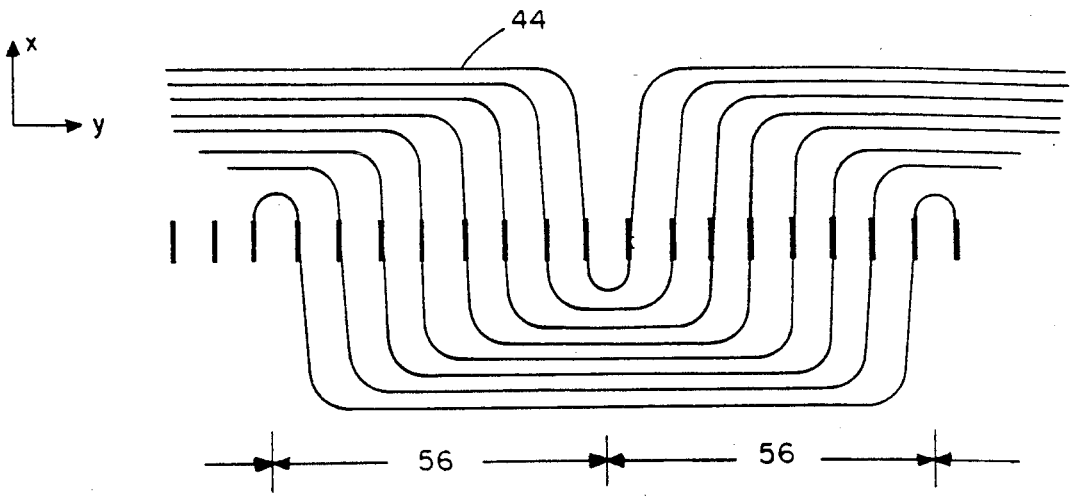
FIG. 8 is a top view of a wiring scheme of grid wires relative to velocity filter plates.

If the modulation of the beam is multiplexed, the number of grid wires can be reduced by using a wiring scheme as illustrated in FIG. 8. One way to multiplex the beam is to divide the cathode into segments, only one at a time of which is appropriately negative with respect to other field elements such that it emits a desired ribbon beam segment. At any one time this active segment of the multiplexed ribbon beam would cover only a portion of the width of the field. The example grid wire arrangement in FIG. 8 uses a single grid wire 44 to control one of every eight beam portions within each beam segment 56. Since only one beam segment is active at any time, each of the eight wires 44 can be time multiplexed and continuously driven. Thus, the total number of required grid wires is significantly reduced.

Because the inside of the CRT 15 is an evacuated chamber, it is typically subject to large compressive atmospheric forces. To prevent implosion in traditional CRTs the CRT walls are made thick and heavy so as to withstand the forces. However, in the preferred embodiment of the present invention, thinner wall surfaces are used, and the tube is braced with a number of parallel septa 41 which run from the back to the front of the CRT 15 (the narrowest dimension). The septa 41 provide the additional support necessary for the thin walls of the CRT 15 to withstand atmospheric pressure. The positioning of the septa 41 is from front to back so that they are parallel with the propagation direction of the ribbon beam 21.

Figure 9:
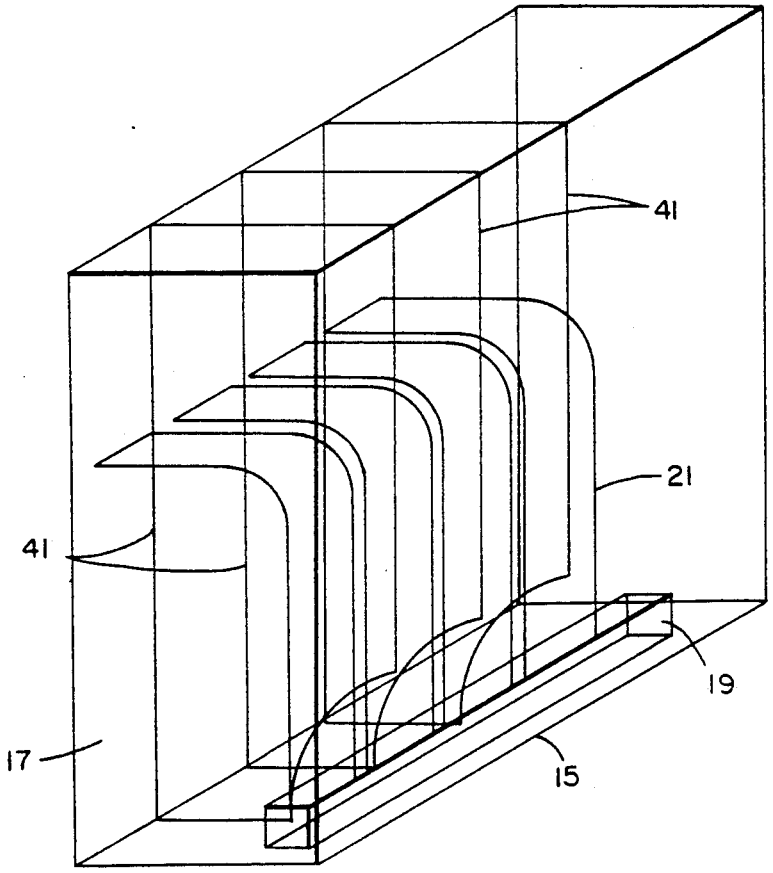
FIG. 9 is a perspective view of a ribbon beam CRT with internal septa.

A preferred arrangement of the septa 41 is shown in FIG. 9. The septa 41 extend from front back and from top to bottom in the CRT 15. The septa 41 are cut away along the bottom rear portion of the CRT 15 to make room for the cathode 19 and the modulation assembly 27. As shown in FIG. 9, the ribbon beam 21 is modulated by the modulation assembly 27 and then travels between the septa 41. The ribbon beam 21 is separated into a number of beam portions 43 by the septa 41. Since the septa 41 run parallel to the direction of the ribbon beam 21, the only discontinuities in the ribbon beam 2 created by the septa 41 are due to the width of the septa 41 in the y-direction. However, the septa 41 must have a large enough thickness-to-depth ratio so that they will not buckle under the compressive forces on the CRT 15 walls, and are therefore sufficiently thick to create ribbon beam discontinuities which are unacceptable for high resolution.

The septa 41 used in the present embodiment are equipped to help prevent the ribbon beam discontinuity problem near the display surface 17. The septa 41 are tapered near the front of the CRT 15 so that their width becomes very narrow at the point of contact with the display surface 17. This tapering allows the septa 41 to retain a high overall thickness-to-depth ratio, while keeping them narrow near the display surface 17. The septa 41 may be loaded with spring assemblies or gaskets at the back wall of the CRT 15 to ensure that the load on the septa 41 is adequately spread out. The width of the septa 41 is made narrow enough at the front of the CRT 15 so that there are no noticeable discontinuities in the resolution of the display surface 17. In a preferred embodiment, the septum width tapers from 400 microns to 60 microns over a distance of about 2 mm.

Figure 10:
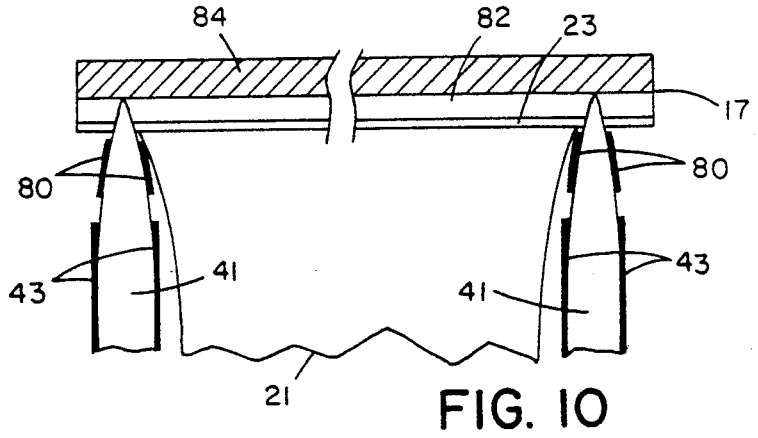
FIG. 10 is an enlarged top view of septa contacting the display surface of the CRT.

FIG. 10 shows an enlarged top view of a section of the display surface 17 upon which two septa 41 are making contact. The septa press through the electrode 23 and the phosphor layer 82 to rest against the glass 84. Although the tapered ends of the septa 41 are sufficiently narrow at the display surface 17, a method of directing portions of the ribbon beam to the pels adjacent the septa 4 is necessary. Small septum electrodes 43 are therefore provided along the septa tapers which can be actively controlled to draw electrons from the ribbon beam inward toward the septa 41, thus illuminating the pels adjacent the septa. These elements 43 are sufficiently negative with respect to electrode 23 that secondary electrons it produces return to it, but are sufficiently positive with respect to deflection electrodes 25 that the ribbon beam 21 fully illuminates the space between the septa 43. In general, beam 21 electrons should not intercept the septa 41, and so travel at a distance of one or two pel widths away from the surfaces of the septa 41. But, on approaching the display surface 17, the electrons along the edge of each ribbon beam portion are deflected right up next to the septa surfaces by the electrodes 43.

In a preferred embodiment, the positions of the septa 41 are aligned with the grid elements 29 of the modulation assembly 27 so that the septa 41 coincide in the y-direction with dividing portions between the grid elements 29. Thus, discontinuities in the ribbon beam 21 created by the septa 4 coincide with discontinuities already existing in the beam due to the separations between the grid elements. The septum electrodes 43 on the tapered portions of the septa are controlled in conjunction with the modulation assembly 27 to illuminate the pels adjacent the edges of the septa according to the image requirements specified by the input video signal. In addition, feedback electrodes 80 are also provided along the septum walls which measure proximate electron beam distance from the septum. The currents picked up by these electrodes are used as feedback to adjust the deflecting septum electrodes to generate a compensating electric field to properly broaden and center the ribbon beam within the inter-septum region.

One notable advantage of the septa-braced embodiment is that the additional support provided allows the glass material 84 used for the display surface 17 to be much thinner than that of traditional CRTs. With the surface 17 being flat and not associated with a shadow mask, the screen phosphors can be printed onto the surface using conventional printing techniques. Such techniques provide a phosphor distribution which typically meets the tolerances of about 1% local distortion and 0.1% absolute distortion as required for a high resolution display surface 17.

Because of the need for a number of rapidly-varying high voltages to control the numerous electrodes in the CRT 15, a method of quickly generating such voltages is required. In the preferred embodiment of the invention these voltages are provided by a second electron gun 45 (FIG. 11) which generates a single beam of electrons. This gun 45 is within the same envelope as the ribbon beam, and is used to control the charge, and therefore the voltage on each of a number of anodes and their connected electrodes. The decay rate of these charges is controlled by a connected resistor or diode network.

Figure 11:
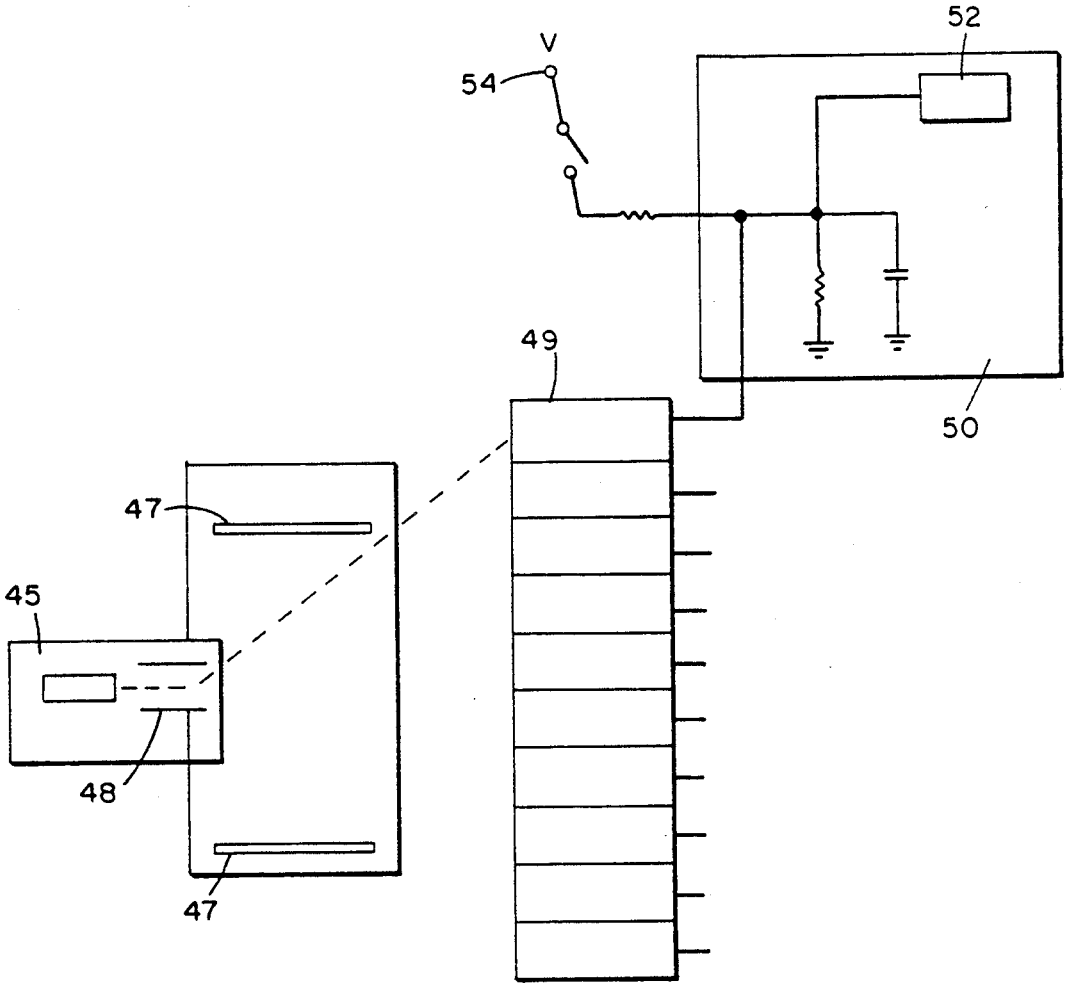
FIG. 11 is an illustration of a system for generating rapidly-varying high voltages.

FIG. 11 demonstrates the basic concept of the high voltage generating gun. In the example of FIG. 11 there are 10 different anodes 49 receiving charge from the electron gun 45. As shown, the electron gun generates a beam of electrons which is directed toward the anode 49 of interest by the electron gun steering electrodes 48. The electron beam then passes through an accelerating field generated by electrodes 47. In the present example, the accelerating potential is 10 kV, but in practice the strength of the field generated by the electrodes 47 is tailored to the system voltage requirements.

Each anode 49 is cup-shaped to receive the electron beam and reduce the escape of secondary electrons reflected or reradiated. Each anode 49 is connected to an RC storage circuit 50 which is in turn connected to the electrode 52 being controlled. Since the voltage provided by the electron beam is restricted in range (e.g. purely negative) several constant value voltages may be used in conjunction with the electron beam arrangement to expand that range. Such a voltage input at terminal 54 of FIG. 11 can be switched in as desired. The constant voltages help reduce the range over which the anode voltages must vary. It is important that each anode cup be revisited by the electron beam sufficiently often that no unacceptable ripple is produced in the output voltages. Electrodes contributing to the same function, such as steering one beam portion, but each requiring different voltage values can use the same anode and adapt the different voltages through the use of resistor bridges.

One embodiment, which reduces the power requirements of the beam deflecting electrodes, allows for the ribbon beam to be swept alternately from top to bottom on the display screen, and then bottom to top. This would prevent the radical changing of electrode voltage which would otherwise be necessary to start each sweep at the same side of the screen. To accomodate this embodiment, however, the images being displayed might have to be altered to reduce artifacts which could occur in some cases.

One variation to the control of the ribbon beam within the CRT 15 uses the divided beam portions of FIG. 8. Instead of sweeping the entire beam across the display surface 17 simultaneously, a single horizontal beam segment can be swept at a time. Each vertical column of the display surface 17 is scanned consecutively, an entire image being formed after all columns are scanned. Although requiring an increased scanning rate to keep the phosphors refreshed, such a method of scanning would greatly reduce the number of output wires from the frame store and their associated processing elements. Similarly, the grids of the modulation assembly would also be multiplexed, allowing a reduced number of control voltages to be generated to control the overall system. Such a division of the beam sweep can be accommodated without having to increase the scanning speed or the beam intensity too substantially. The return is a reduction in the complexity of the signal processing and voltage generation. In addition, this technique can be combined with the alternate sweeping technique of moving the ribbon beam from top to bottom, and then bottom to top. Thus, each consecutive column is swept in the opposite direction as the previous column.

I claim:

1. A cathode ray tube apparatus comprising:

a cathode assembly emitting a ribbon beam of electrons propagating in a first direction;

a linear modulation assembly modulating the ribbon beam emitted from the cathode;

a phosphor-coated display surface upon which electrons of the ribbon beam are incident, absorption of electrons by the phosphor coating causing the emission of visible light from the display surface;

a beam-directing electrode assembly which directs the modulated ribbon beam toward the display surface; and a velocity filter comprising a plurality of parallel velocity filter plates parallel to the propagation direction of the ribbon beam and perpendicular to the plane of the ribbon beam for absorbing electrons of the ribbon beam which have unacceptably high velocities perpendicular to said first direction in the plane of the ribbon beam.

2. A cathode ray tube apparatus according to claim 1 wherein the cathode is elongate in a direction parallel to the plane of the display surface.

3. A cathode ray tube apparatus according to claim 1 wherein the linear modulation assembly comprises a grid of conductive elements through which the ribbon beam must pass, each conductive element individually controlling one portion of the ribbon beam.

4. A cathode ray tube apparatus according to claim 3 wherein the number of grid elements corresponds to the number of picture elements across one dimension of the display surface.

5. A cathode ray tube apparatus according to claim 1 wherein the electron distribution of the ribbon beam emitted from the cathode is substantially uniform across the width of the beam.

6. A cathode ray tube apparatus according to claim 1 wherein absorption of electrons by the phospor coating causes the emission of visible light from the display surface.

7. A cathode ray tube apparatus according to claim 1 wherein the electrode assembly is actively controlled to sweep the ribbon beam across the display surface so as to sequentially illuminate entire adjacent lines on the display surface.

8. A cathode ray tube apparatus according to claim 1 wherein the electrode assembly is actively controlled to impede all but single ribbon beam segments of multiple, independently controlled beam portions for each pass of the ribbon beam across the screen so that the ribbon beam segments sweep through individual columns of the display surface in a sequential manner.

9. A cathode ray tube apparatus according to claim 1 further comprising an acceleration electrode assembly which accelerates electrons of the ribbon beam toward the display surface, the ribbon beam passing through the velocity filter prior to being accelerated by the acceleration electrode assembly.

10. A cathode ray tube apparatus according to claim 1 wherein the modulation assembly controls currents in portions of the ribbon beam by generating fields which deflect electrons in portions of the ribbon beam into the surface of the velocity filter plates.

11. A cathode ray tube apparatus according to claim 1 wherein the velocity filter plates are aligned with separations between the grid elements.

12. A cathode ray tube apparatus according to claim 1 further comprising a plurality of guide plates each having a controllable electrical potential, the guide plates being positioned within the cathode ray tube to reduce fringing fields generated at the edges of the velocity filter plates.

13. A cathode ray tube according to claim 12 wherein the guide plates aid the beam-directing electrode assembly in steering the ribbon beam.

14. A cathode ray tube apparatus according to claim 1 wherein the modulation assembly comprises a plurality of grid wires running perpendicular to the plane of the ribbon beam aligned with and adjacent to the velocity filter plates such that a voltage applied to one of the grid wires causes a controllable amount of the ribbon beam electrons passing near that grid wire to be deflected.

15. A cathode ray tube apparatus according to claim 1 wherein relative electrical potentials are established between adjacent velocity filter plates, the relative potentials generating fields which deflect electrons of ribbon beam portions passing between said adjacent filter plates.

16. A cathode ray tube apparatus according to claim 15 wherein the velocity filter plates are used to modulate the ribbon beam.

17. A cathode ray tube apparatus according to claim 1 wherein the velocity filter plates are positioned adjacent the modulation assembly.

18. A cathode ray tube apparatus according to claim 1 further comprising a beam-focusing electrode assembly for providing focusing of the ribbon beam perpendicular to the plane of the ribbon beam.

19. A cathode ray tube apparatus according to claim 18 wherein the depth of the ribbon beam is expanded by the beam-focusing electrode assembly and reconverged to a focused line at the display surface.

20. A cathode ray tube apparatus according to claim 1 wherein the phosphor coating on the phosphor-coated display surface is printed onto the display surface using conventional printing techniques.

21. A cathode ray tube apparatus according to claim 1 further comprising a frame store memory for receiving and storing input video signals and outputting said video signals in parallel to the modulation assembly.

22. A cathode ray tube apparatus according to claim 21 wherein the outputting of video signals by the frame store is time multiplexed.

23. A cathode ray tube apparatus according to claim 1 wherein said apparatus is a flat-panel cathode ray tube apparatus.

24. A cathode ray tube apparatus comprising:

a cathode assembly emitting a ribbon beam of electrons propagating in a first direction, the electron distribution of the beam being substantially uniform across the width of the beam;

a linear modulation assembly modulating the ribbon beam emitted from the cathode, the modulation assembly including conductive elements which are actively controlled to generate fields which impede propagation of select portions of the ribbon beam;

a phosphor-coated display surface upon which electrons of the ribbon beam are incident, absorption of electrons by the phosphor coating causing the emissions of visible light from the display surface;

a beam-directing electrode assembly which uniformly accelerates the electrons of the ribbon beam, directing the ribbon beam toward the display surface;

a beam-focusing electrode assembly for providing focusing of the ribbon beam perpendicular to the plane of the ribbon beam; and an electrostatic velocity filter comprising a plurality of parallel velocity filter plates parallel to the propagation direction of the ribbon beam and perpendicular to the plane of the ribbon beam for removing electrons from the modulated ribbon beam, the removed electrons having unacceptably high velocities in a direction perpendicular to the beam propagation direction in the plane of the ribbon beam.

25. A cathode ray tube apparatus comprising:

a cathode emitting a ribbon beam of electrons propagating in a first direction;

a modulation assembly modulating the ribbon beam emitted from the cathode;

a phosphor-coated display surface upon which electrons of the ribbon beam are incident, absorption of electrons by the phosphor coating causing the emission of visible light form the display surface;

a beam-directing electrode assembly which redirect the ribbon beam toward the display surface;

a plurality of thin septa positioned within the cathode ray tube and aligned parallel with the direction of ribbon beam propagation the septa bracing tube surfaces from compressive forces on the tube wherein the thickness of each septum is tapered near the display surface such that the narrowest part of each septum contacts the display surface; and septum electrodes located along the tapered part of each septum to draw electrons toward the septum.

26. A cathode ray tube apparatus according to claim 25 wherein the septa are perpendicular supports between the display surface and an opposing inner surface of the cathode ray tube.

27. A cathode ray tube apparatus according to claim 25 further comprising a resilient assembly between the septa and a wall of the cathode ray tube being braced by them.

28. A cathode ray tube apparatus according to claim 25 wherein the phosphor coating of the phosphor-coated display surface is printed onto the display surface using conventional printing techniques.

29. A cathode ray tube apparatus according to claim 25 wherein the cathode is elongate in a direction parallel to the plane of the display surface.

30. A cathode ray tube apparatus according to claim 25 wherein the modulation assembly is a linear modulation assembly.

31. A cathode ray tube apparatus according to claim 30 wherein the linear modulation assembly comprises a grid of conductive elements through which the ribbon beam must pass, each conductive element individually controlling one portion of the ribbon beam.

32. A cathode ray tube apparatus according to claim 25 wherein the electron distribution of the ribbon beam emitted from the cathode is substantially uniform across the width of the beam.

33. A cathode ray tube apparatus according to claim 25 wherein the electrode assembly is actively controlled to sweep the ribbon beam across the display surface so as to sequentially illuminate entire lines on the display surface.

34. A cathode ray tube apparatus according to claim 25 wherein the electrode assembly is actively controlled to impede all but single segments of the ribbon beam, each segment having multiple beam portions, for each pass of the ribbon beam across the screen so that the ribbon beam segments sweep through individual columns of the display surface in a sequential manner.

35. A cathode ray tube apparatus according to claim 25 further comprising an electrostatic velocity filter for absorbing electrons of the ribbon beam which have relatively high velocities perpendicular to said first direction in the plane of the ribbon beam.

36. A cathode ray tube apparatus according to claim 25 further comprising a beam-focusing electrode assembly for providing focusing of the ribbon beam perpendicular to the plane of the ribbon beam.

37. A cathode ray tube apparatus according to claim 36 wherein the depth of the ribbon beam is expanded by the beam-focusing electrode assembly and reconverged to a focused line at the display surface.

38. A cathode ray tube apparatus according to claim 25 wherein said apparatus is a flat-panel cathode ray tube apparatus.

39. A cathode ray tube apparatus comprising:

a cathode emitting a ribbon beam of electrons propagating in a first direction;

a modulation assembly modulating the ribbon beam emitted from the cathode;

a phosphor-coated display surface upon which electrons of the ribbon beam are incident, absorption of electrons by the phosphor coating causing the emission of visible light from the display surface;

a beam-directing electrode assembly which redirect the ribbon beam toward the display surface;

a plurality of thin septa positioned within the cathode ray tube and aligned parallel with the direction of ribbon beam propagation, the septa bracing tube surfaces from compressive forces on the tube wherein the thickness of each septum is tapered near the display surface such that the narrowest part of each septum contacts the display surface; and feedback electrodes positioned along the tapered portion of each septum for measuring proximate electron beam position.

40. A cathode ray tube apparatus comprising:

a cathode emitting a ribbon beam of electrons propagating in a first direction;

a modulation assembly modulating the ribbon beam emitted from the cathode;

a phosphor-coated display surface upon which electrons of the ribbon beam are incident, absorption of electrons by the phosphor coating causing the emission of visible light form the display surface;

a beam-directing electrode assembly which redirect the ribbon beam toward the display surface;

a plurality of thin septa positioned within the cathode ray tube and aligned parallel with the direction of ribbon beam propagation the septa bracing tube surfaces from compressive forces on the tube wherein the thickness of each septum is tapered near the display surface such that the narrowest part of each septum contacts the display surface;

septum electrodes located along the tapered part of each septum; and an electrostatic velocity filter comprising a plurality of parallel velocity filter plates parallel to the propagation direction of the ribbon beam and perpendicular to the plane of the ribbon beam for absorbing electrons of the ribbon beam which have relatively high velocities perpendicular to said first direction in the plane of the ribbon beam.

41. A cathode ray tube apparatus according to claim 40 wherein the modulation assembly controls the current in portions of the ribbon beam by generating fields which deflect electrons of the ribbon beam into the surface of the velocity filter plates.

42. A cathode ray tube apparatus according to claim 40 further comprising a plurality of guide plates each having a controllable electrical potential, the guide plates being positioned within the cathode ray tube to reduce fringing fields generated at the edges of the velocity filter plates.

43. A cathode ray tube apparatus according to claim 40 further comprising a beam-focusing electrode assembly for providing focusing of the ribbon beam perpendicular to the plane of the ribbon beam.

44. A cathode ray tube according to claim 43 wherein the guide plates aid the beam-focusing electrode assembly in focusing the ribbon beam.

45. A cathode ray tube apparatus according to claim 40 wherein the modulation assembly comprises a plurality of grid wires running perpendicular to the plane of the ribbon beam aligned with and adjacent to the velocity filter plates such that certain voltages applied to one of the grid wires causes ribbon beam electrons passing near that grid wire to be deflected.

46. A cathode ray tube apparatus according to claim 40 wherein relative electrical potentials are established between adjacent velocity filter plates, the relative potentials generating fields which deflect electrons of ribbon beam portions passing between said adjacent filter plates.

47. A cathode ray tube apparatus according to claim 46 wherein the velocity filter plates are used to modulate the ribbon beam.

48. A cathode ray tube apparatus comprising:

a cathode assembly emitting a ribbon beam of electrons propagating in a first direction, the electron distribution of the beam being substantially uniform across the width of the beam;

a modulation assembly modulating the ribbon beam emitted from the cathode, the modulation assembly including conductive elements which are actively controlled to impede propagation of select portions of the ribbon beam;

a phosphor-coated display surface upon which electrons of the ribbon beam are incident, absorption of electrons by the phosphor coating causing the emission of visible light from the display surface;

a beam-directing electrode assembly which uniformly accelerates the electrons of the ribbon beam, directing the ribbon toward the display surface;

a plurality of thin septa positioned within the cathode ray tube and aligned parallel with the direction of ribbon beam propagation to brace tube surfaces from compressive forces on the tube, the septa being tapered near the display surface; and septum electrodes along the tapered region of each septum to draw electrons toward the tapered regions.

49. A cathode ray tube apparatus comprising;

a cathode emitting a ribbon beam of electrons propagating in a first direction;

a plurality of velocity filter plates perpendicular to the ribbon beam and parallel with the propagation direction of the ribbon beam, and through which portions of the ribbon beam must travel, each filter plate having an electrical potential sufficient to sustain absorption of most electron beam electrons coming in contact with it;

a phosphor-coated display surface upon which electrons of the ribbon beam are incident, absorption of electrons by the phosphor coating causing the emission of visible light from the display surface; and a beam-directing electrode assembly which directs the modulated ribbon beam toward the display surface.

50. A cathode ray tube apparatus according to claim 49 further comprising a plurality of grid wires perpendicular to the plane of the ribbon beam and positioned between the cathode and the velocity filter plates, the grid wires being actively controllable such that when currents are passed through the grid wires, electric fields are generated about the grid wires which affect the trajectory of nearby ribbon beam electrons.

51. A cathode ray tube apparatus according to claim 49 wherein the beam-directing electrode assembly is actively controlled to sweep the ribbon beam across the display surface so as to sequentially illuminate entire adjacent lines on the display surface.

52. A cathode ray tube apparatus according to claim 49 wherein the beam-directing electrode assembly is actively controlled to impede all but single segments of the ribbon beam for each pass of the ribbon beam across the screen so that the ribbon beam segments sweep through individual columns of the display surface in a sequential manner.

53. A cathode ray tube apparatus according to claim 49 further comprising a plurality of guide plates each having a controllable electrical potential, the guide plates being positioned within the cathode ray tube to reduce fringing fields generated at the edges of the velocity filter plates.

54. A cathode ray tube according to claim 53 wherein the guide plates are positioned to aid the beam directing electrode assembly in directing the ribbon beam.

55. A cathode ray tube apparatus according to claim 49 wherein relative electrical potentials are established in an actively controlled manner between adjacent velocity filter plates to selectively reduce the beam current of portions of the ribbon beam.

56. A cathode ray tube apparatus according to claim 49 further comprising a beam-focusing electrode assembly for providing focusing of the ribbon beam perpendicular to the plane of the ribbon beam.

57. A cathode ray tube apparatus according to claim 56 wherein the depth of the ribbon beam is expanded by the beam-focusing electrode assembly and reconverged to a focused line at the display surface.

58. A cathode ray tube apparatus according to claim 49 further comprising a plurality of thin septa supporting inner surfaces of the cathode ray tube and aligned parallel with the direction of ribbon beam propagation, the septa bracing tube surfaces from compressive forces on the tube.

59. A cathode ray tube apparatus according to claim 49 wherein the phosphor on said phosphor-coated display surface is printed on using conventional printing techniques.

60. A cathode ray tube apparatus according to claim 49 further comprising a frame store memory for receiving and storing input video signals and and outputting said video signals to the modulation assembly.

61. A cathode ray tube apparatus according to claim 60 wherein the outputting of video signals by the frame store memory is time multiplexed.

62. A cathode ray tube apparatus according to claim 49 wherein said apparatus is a flat-panel cathode ray tube apparatus.

63. A cathode ray tube apparatus comprising:

a cathode assembly emitting a ribbon beam of electrons propagating in a first direction, the electron distribution of the beam being substantially uniform across the width of the beam;

a linear modulation assembly comprising a grid of conductive elements through which the ribbon beam must pass, each conductive element affecting one individual portion of the ribbon beam;

a phosphor-coated display surface upon which electrons of the ribbon beam are incident, absorption of electrons by the phosphor coating causing the emission of visible light from the display surface;

a beam-directing electrode assembly which directs the modulated ribbon beam toward the display surface, the electrode assembly being actively controlled to sweep the ribbon beam across the display surface to sequentially illuminate adjacent lines on the display surface; and an electrostatic velocity filter for absorbing ribbon beam electrons having unacceptably high velocities perpendicular to said first direction in the plane of the ribbon beam, the velocity filter comprising a plurality of parallel velocity filter plates parallel to the propagation direction of the ribbon beam and perpendicular to the plane of the ribbon beam.

64. A method of displaying a video image, the method comprising:

providing a cathode ray tube having a cathode assembly emitting a ribbon beam in a first direction;

modulating the ribbon beam with a linear modulation assembly;

filtering the ribbon beam with an electrostatic velocity filter comprising a plurality of parallel velocity filter plates parallel to the propagation direction of the ribbon beam and perpendicular to the plane of the ribbon beam which absorb electrons of the ribbon beam having unacceptably high velocities perpendicular to said first direction in the plane of the ribbon beam;

providing a phosphor-coated display surface upon which electrons of the ribbon beam are incident; and directing the modulated ribbon beam toward the display surface with a beam-directing electrode assembly.

65. A method according to claim 64 wherein modulating the ribbon beam comprises passing the ribbon beam through a grid of conductive elements, each conductive element individually controlling one portion of the ribbon beam.

66. A method according to claim 64 wherein directing the ribbon beam toward the display surface further comprises actively controlling the beam-directing electrode assembly to sweep the ribbon beam across the display surface so as to sequentially illuminate entire adjacent lines on the display surface.

67. A method according to claim 64 wherein the beam-directing electrode assembly is actively controlled to impede all but single segments of the ribbon beam for each sweep of the ribbon beam across the screen so that the ribbon beam segments sweep through individual columns of the display surface in a sequential manner.

68. A method according to claim 64 further comprising accelerating the ribbon beam toward the display surface with an acceleration electrode assembly, the electrons passing through the velocity filter prior to being accelerated by the acceleration electrode assembly.

69. A method according to claim 64 further providing a plurality of guide plates each having a controllable electrical potential, the guide plates being positioned within the cathode ray tube to reduce fringing fields generated at the edges of the velocity filter plates.

70. A method according to claim 64 wherein the velocity filter plates each have a controllable electrical potential and are used to modulate the ribbon beam.

71. A method according to claim 64 further comprising providing a beam-focusing electrode assembly which expands the depth of the ribbon beam and reconverges it to a focused line at the display surface.

72. The method of claim 64 further comprising bracing the inner surfaces of the cathode ray tube against compressive external forces with a plurality of thin septa extending between opposing surfaces.

73. A method of displaying a video image, the method comprising:

providing a cathode ray tube having a cathode assembly emitting a ribbon beam in a first direction, the electron distribution of the beam being substantially uniform across the width of the beam;

modulating the ribbon beam with a linear modulation assembly comprising a grid of conductive elements through which the ribbon beam must pass, each conductive element affecting one individual portion of the ribbon beam;

providing a phosphor-coated display surface upon which electrons of the ribbon beam are incident, absorption of electrons by the phosphor-coating causing the emission of visible light from the display surface;

focusing the ribbon beam perpendicular to the plane of the ribbon beam with a beam-focusing electrode assembly;

directing the modulated ribbon beam toward the display surface with a beam-directing electrode assembly, the electrode assembly being actively controlled to sweep the ribbon beam across the display surface to sequentially illuminate adjacent lines on the display surface; and filtering the ribbon beam with an electrostatic velocity filter which absorbs ribbon beam electrons having unacceptably high velocities perpendicular to said first direction in the plane of the ribbon beam, the velocity filter comprising a plurality of parallel velocity filter plates parallel to the propagation direction of the ribbon beam and perpendicular to the plane of the ribbon beam.

* * * * *

UNITED STATES PATENT AND TRADEMARK OFFICE

CERTIFICATE OF CORRECTION

PATENT NO. : 5,130,614

DATED : July 14, 1992

INVENTOR(S) : David H. Staelin

It is certified that error appears in the above-identified patent and that said Letters Patent is hereby corrected as shown below:

In Claim 25, column 13, line 25, change "form" to ---from---, and in line 26, change "redirect" to ---redirects---.

In Claim 39, Column 14, line 35, change "redirect" to ---redirects---.

In Claim 40, column 14, line 57, change "form" to ---from---, and in line 58, change "redirect" to ---redirects---.

In Claim 43, column 15, line 20, change "40" to ---42---.

In Claim 49, column 15, line 68, change ";" to ---:---.

In Claim 60, column 17, line 5, delete one occurrence of the word "and".

Signed and Sealed this

Seventeenth Day of August, 1993

*Attest:*

*Attesting Officer*

Bruce Lehman

BRUCE LEHMAN

*Commissioner of Patents and Trademarks*